US006219984B1

(12) United States Patent
Piccone

(10) Patent No.: US 6,219,984 B1
(45) **Date of Patent: *Apr. 24, 2001**

(54) INTERCONNECTABLE FORMWORK ELEMENTS

(76) Inventor: Francesco Piccone, 5076 Connaught Drive, Vancouver (CA), V6M 3G1

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/952,594

(22) PCT Filed: May 11, 1995

(86) PCT No.: PCT/CA95/00281

§ 371 Date: Nov. 13, 1997

§ 102(e) Date: Nov. 13, 1997

(87) PCT Pub. No.: WO96/35845

PCT Pub. Date: Nov. 14, 1996

(51) Int. Cl.[7] ..... E04B 2/46

(52) U.S. Cl. ..... 52/426; 52/404.1; 52/417; 52/431; 52/439; 52/468; 52/745.1

(58) Field of Search ..... 52/379, 404.1, 52/417, 426, 429, 431, 432, 436, 439, 441, 442, 463, 464, 465, 468, 471, 561, 592.1, 742.14, 745.1, 745.13

(56) References Cited

U.S. PATENT DOCUMENTS

| | | | | |
|---|---|---|---|---|
| 1,035,206 | * | 8/1912 | Lewen | 52/426 X |
| 1,345,156 | * | 6/1920 | Flynn | 52/426 X |
| 2,050,258 | * | 8/1936 | Bemis . | |
| 3,555,751 | * | 1/1971 | Thorgusen | 52/426 X |
| 4,104,837 | * | 8/1978 | Naito | 52/742.14 X |
| 4,180,956 | * | 1/1980 | Gross | 52/563 X |
| 5,216,863 | * | 6/1993 | Nessa et al. | 52/439 |
| 5,465,545 | * | 11/1995 | Trousilek | 52/439 X |
| 5,491,947 | * | 2/1996 | Kim | 52/426 |
| 5,553,430 | * | 9/1996 | Majnaric et al. | 52/426 X |
| 5,608,999 | * | 3/1997 | McNamara | 52/429 X |
| 5,740,648 | * | 4/1998 | Piccone | 52/426 |

FOREIGN PATENT DOCUMENTS

| | | | |
|---|---|---|---|
| 957816 | * | 11/1974 | (CA) . |
| 507787 | * | 9/1920 | (FR) . |
| 1381945 | * | 11/1964 | (FR) . |
| 82 04088 | * | 11/1982 | (WO) . |
| 95 00724 | * | 1/1995 | (WO) . |

* cited by examiner

*Primary Examiner*—Carl D. Friedman
*Assistant Examiner*—Kevin D. Wilkens
(74) *Attorney, Agent, or Firm*—Galgano & Burke

(57) ABSTRACT

Interconnectable formwork elements for casting vertical concrete structures adapted to interconnect to one another along their longitudinal sides to create a formwork for casting concrete to form a wall other vertical structure.

17 Claims, 5 Drawing Sheets

INTERCONNECTABLE FORMWORK ELEMENTS

TECHNICAL FIELD OF THE INVENTION

This invention relates to formwork for casting vertical concrete structures such as walls.

The forms of the invention are elongated modular elements which are adapted to interconnect to one another along their longitudinal sides to create overall formwork for casting concrete to form a wall or other vertical structure.

BACKGROUND ART

It is known in the prior art to provide modular form elements which may be stacked end to end and wherein a plurality of horizontal courses are superposed one upon the other to create a wall of formwork. Examples of such elements are disclosed in U.S. Pat. No. 2,172,052 to Robbins and U.S. Pat. No. 3,788,020 to Gregori.

It is also known to provide modular form elements consisting of a plurality of vertical and essentially closed forms which can be nested alongside one another to create a series of adjacent concrete columns. U.S. Pat. No. 5,216,863 to Nessa et al. discloses such elements having generally circular or octagonal cross sections. In Nessa's octagonal cross section embodiment, the cross section of the form element comprises the general shape of an octagon with one side missing so as to create an open side. The free edges adjacent the open side are provided with retaining means which are designed to cooperate with complementary retaining means mounted on the back of an adjacent element. A plurality of elements can thereby be secured to one another, "piggyback" style, to create a formwork of columns into which concrete can be poured.

There are a number of desirable objectives in relation to modular form elements. Where it is intended to leave the form in place after casting the concrete, it is desirable to provide a form element which enables the easy application of wall finishes or coverings to the surface thereof. An important feature is the ability to allow the concrete to flow between interconnected form elements so so as to provide strength and rigidity to the concrete structure. It is also desirable to be able to insert reinforcing rods in the formwork. The formwork should be waterproof to prevent corrosion of reinforcing elements embedded in the concrete. It is also desirable for finished formwork to offer insulation properties.

Various prior art approaches achieve some of these objectives, but with varying success. For example, in the case of U.S. Pat. No. 5,216,863 it is difficult to provide insulation or liner within the form, mainly because of the essentially closed nature of the octagonal or circular form, and the structure of the form tends to impede the flow of concrete between adjacent forms. Moreover, the resulting formwork lacks structural rigidity and when the formwork is filled with concrete, it suffers from a "banana effect" which causes the walls of the form elements to bulge out. This makes it difficult to secure wall finishes and coverings.

DISCLOSURE OF THE INVENTION

According to one of its aspects, the invention comprises a modular formwork assembly having an elongated, generally concave element and an elongated connecting member and two longitudinal edges connected by spaced ribs. The connecting member is provided with engaging means at each edge each of which engaging means enables the connection of elements arranged in end to end relationship about an edge of the connecting element. The elements are provided with engaging means along their longitudinal edges for cooperating with the connecting means of the connecting members. The engaging means of the elements and those of the members are adapted to cooperate by sliding engagement. The connecting element thereby acts to simultaneously connect two facing elements to one another as well as to connect two elements presented in end to end relationship to one another.

The generally open or concave shape of the elements allows the application of insulation or liner to the inner surface thereof and/or the nesting of elements for easy transportation while the modular aspect of the elements and connecting members enables easy assembly by workmen.

The resulting assembly provides a formwork which substantially maintains its shape when filled with concrete and which does not suffer from "banana effect" . The spacing of the ribs of the connecting member provides pathways for the insertion into the formwork of reinforcing rods, and also allows the integral formation of horizontal lengths of concrete along the pathways formed by aligned spaces between the ribs of adjacent elements.

In another aspect, the invention is a method of erecting formwork using the assembly described above comprising the steps of first erecting one side of the formwork by providing a plurality of connecting members wherein the engaging means on a single, common side of the plurality of connecting members are engaged in the engaging means of a plurality of the elements so as to retain the plurality of elements in edge to edge relationship. The next step is to install reinforcing rods in the spaces between the ribs of the connecting members, then installing a plurality of the elements in edge to edge relationship in engagement with the engaging means on an opposite side of the connecting members whereby to complete a second side of the formwork wall.

BRIEF DESCRIPTION OF THE DRAWINGS EMBODIMENT

Other aspects of the invention will be evident from the following disclosure and description of the preferred embodiment and from the drawings in which.

DETAILED DESCRIPTION OF THE BEST MODE AND PREFERRED EMBODIMENT OF THE INVENTION

Figure 1:
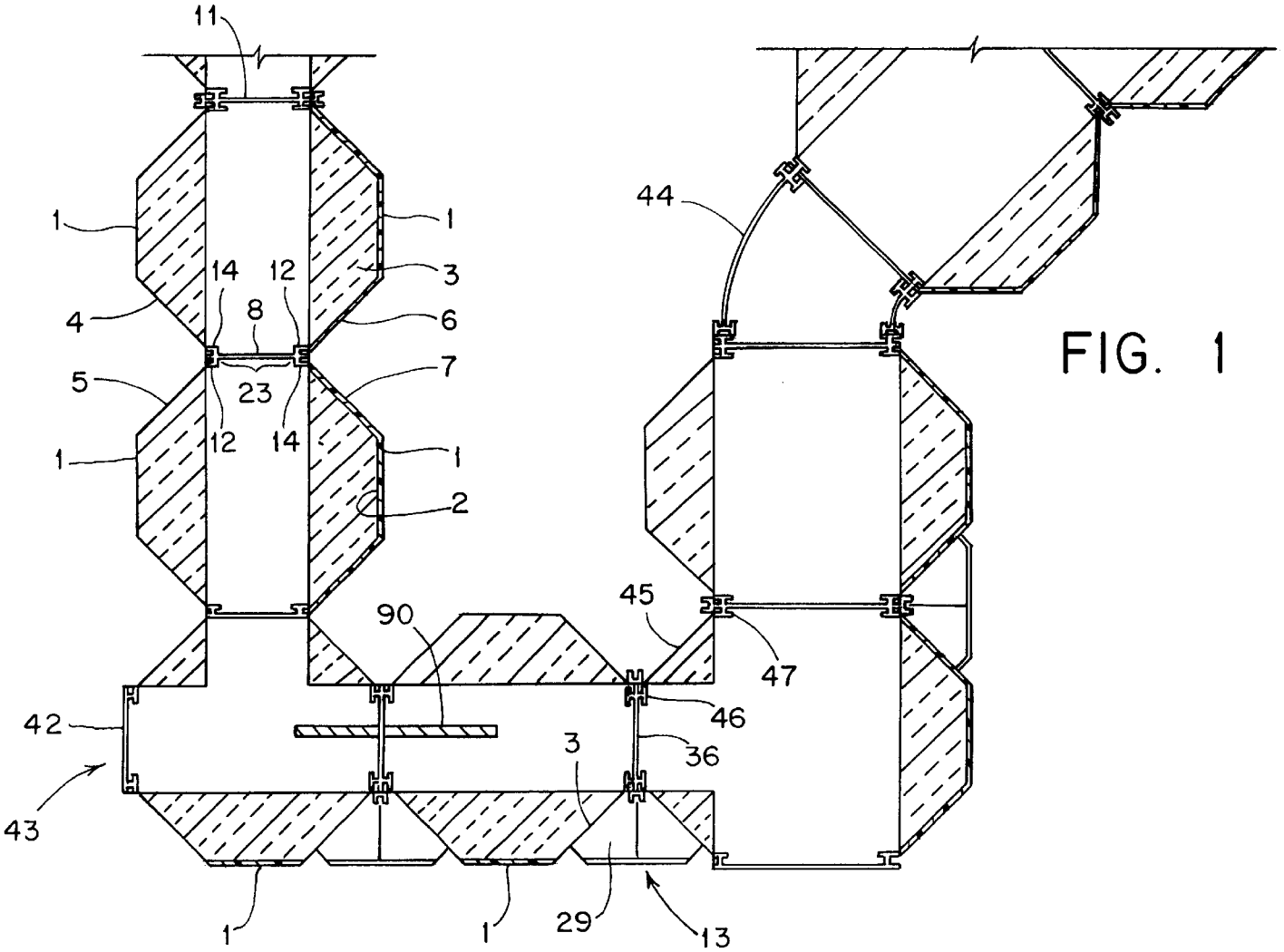
FIG. 1 is a schematic plan view of an assembly of formwork illustrating connecting members, elements and gap finishing pieces according to the invention.

Referring to FIG. 1, a plurality of generally concave elongated form elements 1 are provided. The elements are preferably made of a material such as polyvinylchloride as are the other components described herein. The elements have a surface 50 which may be three sided or they may have more sides, be rounded or any other suitable shape, provided the elements are essentially open so that the edges do not close towards each other. As used herein, such shapes are referred to for simplicity as "concave". The use of such shapes give a column-like appearance to the formwork. The concavity also allows easy access to the inside face 2 of the element 1 for the placing or bonding of various types of insulation or liner within the inside face of the element prior to erection of the formwork or at the time of manufacture of the elements 1. Foam type insulation as a 3 may be used or a composite insulation or a thinner liner may be bonded to the inner surface of the element. Alternatively, the element can be used without any insulation or liner.

The open concave shape of the elements also allows a plurality of elements to be nested for compact and easy transportation thereby reducing transportation costs.

A formwork wall is created by placing a course of elements 1 adjacent one another in edge to edge relationship, as between elements 4 and 5 in FIG. 1, placing a second course of elements adjacent one another in edge to edge relationship, as between elements 6 and 7 in FIG. 1, and inter-connecting the elements by means of connecting members, as described below.

Figure 2:
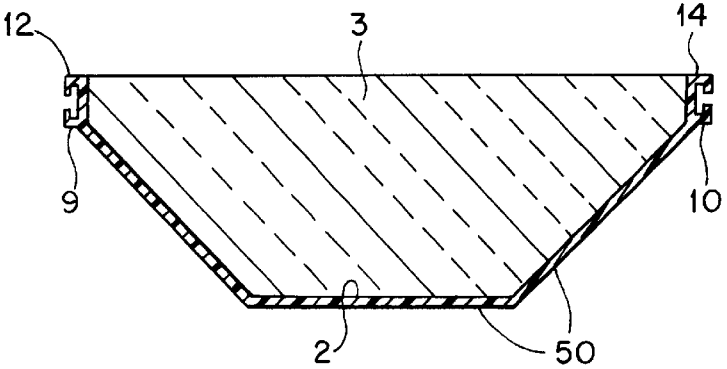
FIG. 2 is an end view of an element according to the invention including insulation on the inner surface thereof.

Referring to FIG. 2, the longitudinal edges 9, 10 of elements 1 are provided with engaging means 12, 14. In the preferred embodiment, the engaging means are in the shape of the female portion of a T connector.

Figure 3:
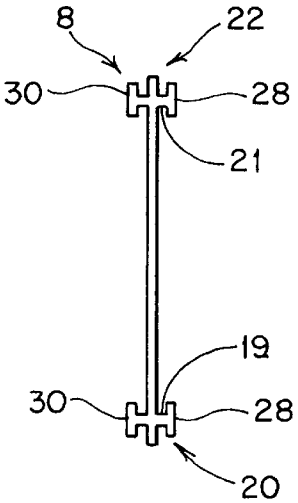
FIG. 3 is an end view of one embodiment of a connecting member according to the invention.
Figure 4:
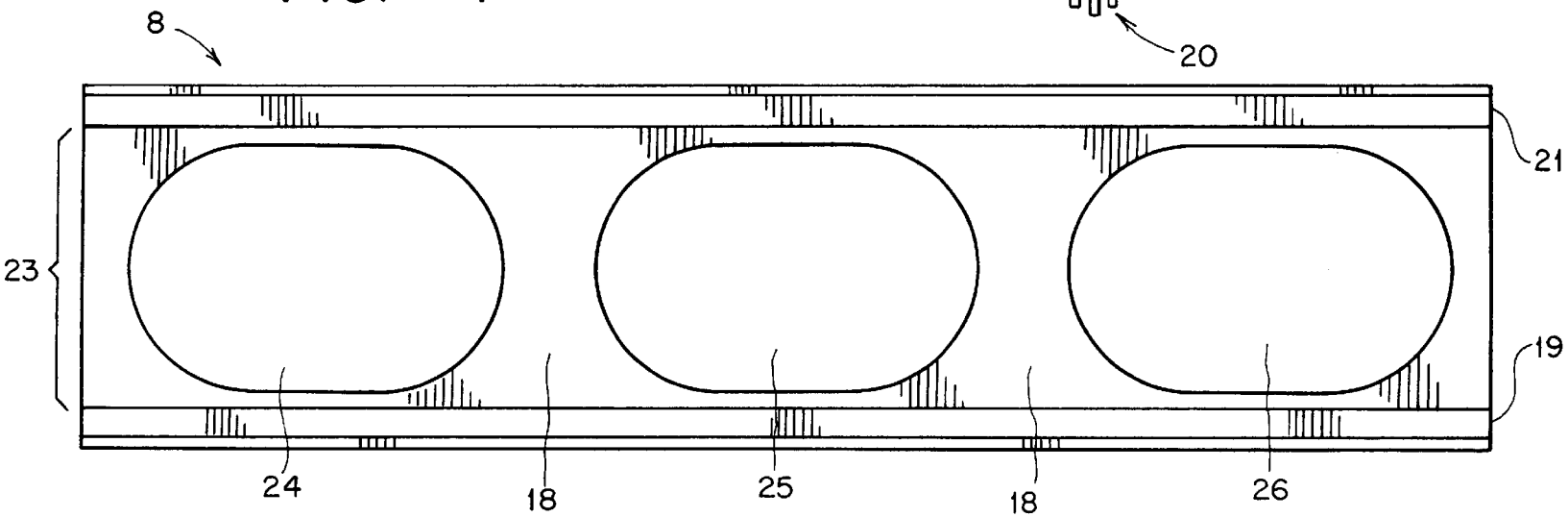
FIG. 4 is a front view of a length of the connecting member shown in FIG. 3.

A connecting member 8 according to the invention is illustrated in FIG. 3 and in FIG. 4. A series of ribs 18 extend in the central portion 23 along the length of the connecting member 8 between longitudinal edges 19, 21. Engaging means 20, 22 are provided at each edge 19, 21 of connecting member 8. In the preferred embodiment, engaging means 20 in turn consists of two male portions 28, 30 of a T connector disposed opposite one another in relation to the central portion 23. The same arrangement is provided for engaging means 22. Each of the male portions of the T connector are sized to cooperate with the female portions 12, 14 of the T connector which form part of the element 1.

Referring again to FIG. 1, the engaging means 20, 22 of connecting member 8 can be positioned in relation to engaging means 12, 14 of four elements 4, 5, 6, 7, then slid into engagement with them along the length of the connecting member 8 and of the elements 4, 5, 6, 7 (i.e. into the plane of FIG. 1). Connecting member 8 thereby acts as a spacer to hold elements 5 and 7 and elements 4 and 6 a controlled distance apart from one another. This, as well as the fact that the concrete can flow laterally between ribs 18 of the connecting members, prevents the bulging outward of the interconnected elements once the concrete which is poured into the formwork.

It will be appreciated that the connecting member 8 acts not only to hold the facing elements 5, 7 and 4, 6 a certain distance from one another, but also to secure laterally adjacent elements 4, 5 and 6, 7 in edge to edge relationship to one another.

Once one connecting member is slidingly engaged with a first set of four elements, another connecting member can be slid into engagement with the engaging means on the end of the elements opposite the connecting member which is already installed. Thus a wall of formwork is gradually erected. Since the engagement between the connecting members and the elements is a sliding one, the formwork or any given connecting member can be disassembled easily, provided the concrete has not been poured.

As noted above, the connecting member 8 is provided with ribs 18. Ribs 18 are spaced from one another a sufficient distance to ensure a minimum of impedance to the flow of concrete through the central portion 23.

The spaced ribs 18 also allow the introduction in the spaces (24, 25, 26) of reinforcing rods 90 to extend along the lateral length of the wall, for example between connecting elements 8, 11. The reinforcing rods may in fact be disposed in any orientation within the plane of the concrete wall, with the only limitation being the existence of a linear arrangement of spaces between the ribs 18 of adjacent members along the pathway to be followed by the reinforcing rod. Thus the rods may be arranged either horizontally or diagonally according to the regularly and spacing of the ribs in adjacent connecting members. leaving the opposite edge of the connecting members free. With appropriate bracing of the resulting structure it is then possible to install reinforcing rods in the pathways defined by successive spaces between the ribs of the connecting members. As only one side of the formwork will have been erected, the overall pattern of reinforcing rods is visible from the open side of the formwork allowing an evaluation of the suitability of the reinforcing scheme. Once the reinforcing rods are satisfactorily installed, the complementary side of the formwork may be erected by sliding a plurality of elements into the engaging means on the free edges of the connecting members.

Figure 11:
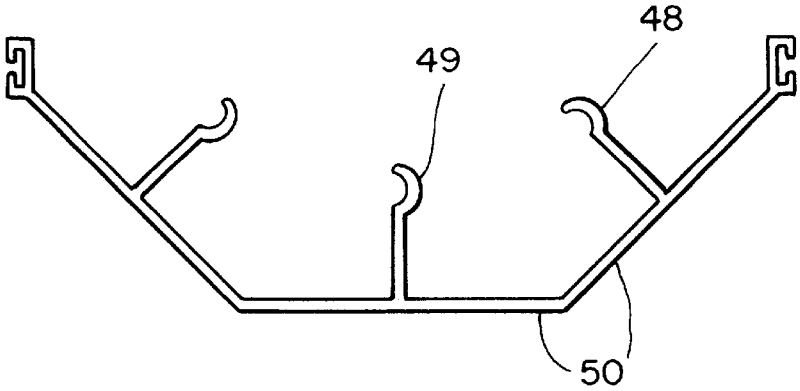
FIG. 11 is an end view of an element with anchors according to one embodiment of the invention.

Anchors 48, 49 may also be provided which project inwardly of the surface 50 of the element as shown in FIG. 11 so as to engage the concrete after it is poured and in order to provide additional rigidity to the structure.

As advantage of the assembly according to the invention that if a thick layer of insulation 3 is provided on the inner surface of the element 1 it is possible to provide cut outs in the form and the insulation to provide a cavity for the installation of electrical boxes and the like. Even after the concrete hardens in the form, it would still be possible, if necessary, to cut out a portion of the element 1 and its associated portion of insulation to provide the necessary cavity.

Figure 9:
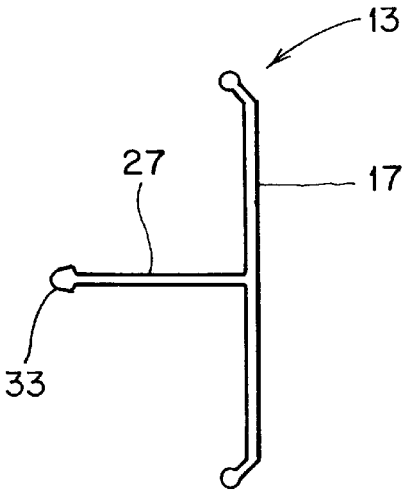
FIG. 9 is an end view of a gap finishing piece according to the invention.

The external appearance of a course of elements joined by connecting members will be a row of abutting columns as may be appreciated by considering the overall view offered by FIG. 1. However, in some cases, it will be desirable to present a flat exterior or interior surface to the wall. This may be achieved with elements as described herein by the use of an elongated gap finishing piece 13, seen in FIG. 1 and illustrated more particularly in FIG. 9. The gap finishing piece 13 consists of a substantially flat surface 17 and a projection 27 extending from the flat surface 17. The gap finishing piece can be positioned to cover the gap 29 created by the walls 31, 32 of adjacent elements.

Figure 5:
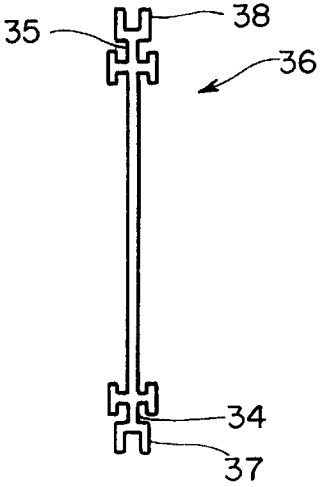
FIG. 5 is an end view of an embodiment of a connecting member according to the invention including engaging means for a gap finishing piece.
Figure 6:
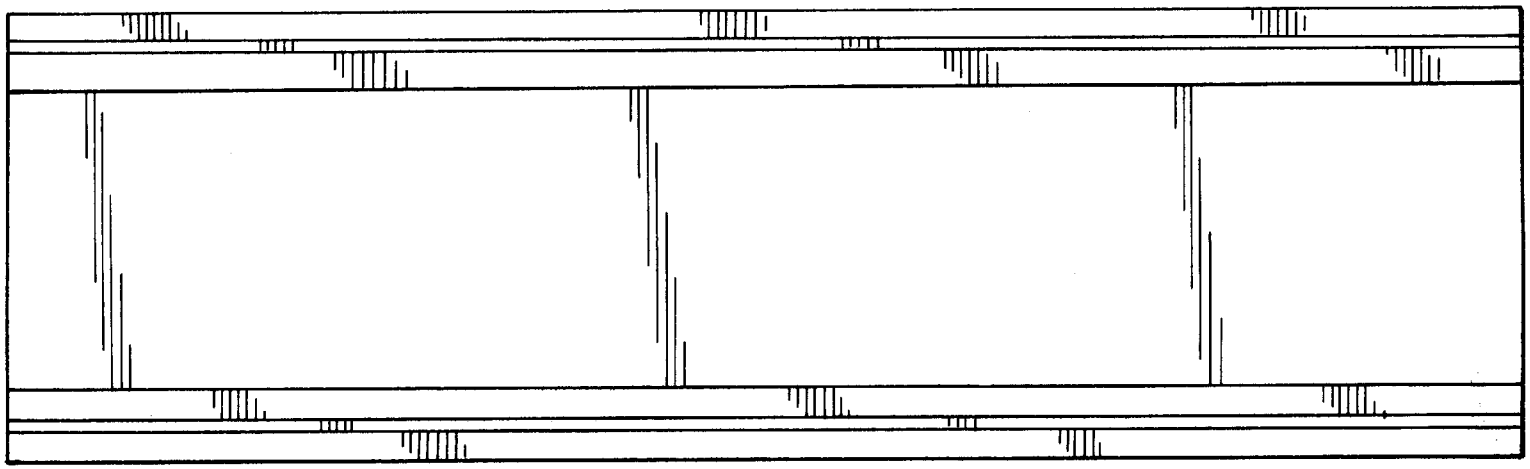
FIG. 6 is a front view of a length of the connecting member of FIG. 5.

The projection 27 of the gap finishing piece 13 is provided with an arrowhead shaped end 33. In order to retain the gap finishing piece 13 in place over the gap 29, a different embodiment of a connecting member from that described above is used, as illustrated in FIGS. 5 and 6, although such member may be incorporated in the formwork assembly as seen in FIG. 1. Extending directly outward from each edge 34, 35 of the member 36 there are provided engaging means 37, 38 consisting of sockets in the preferred embodiment. Such a connecting element 36 is also illustrated in FIG. 1. The sockets 37, 38 and the arrowhead shaped and 33 of the projection 27 are sized to cooperate with one another in a ball and socket type of connection. The gap finishing piece 13 may therefore be retained to cover the gap 29 by applying pressure so as to insert the end 33 into the socket 37 or 38.

Figure 7:
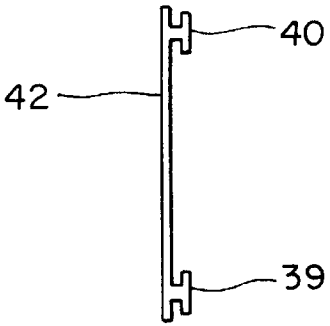
FIG. 7 is an end view of a connecting member according to another embodiment of the invention for closing one end of a course of elements.
Figure 8:
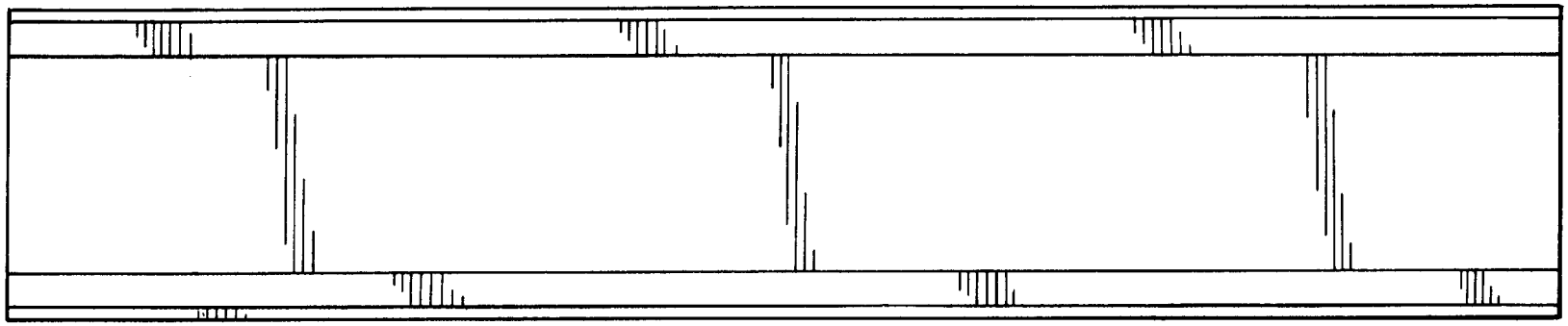
FIG. 8 is a front view of a length of the connecting member of FIG. 7.

Another embodiment of a connecting member (42) is illustrated in FIG. 7. Such as embodiment includes engaging means 39, 40 at one side only of connecting member 42. The central portion of the connecting member is also continuous and substantially planar to the edges of the member. As a result, the connecting member 42 can be used to close the end of a course of elements as at 43 in FIG. 1.

Figure 10:
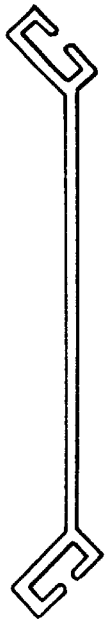
FIG. 10 is an end view of an angle piece according to one embodiment of the invention.

It will be appreciated that various complementary components may also be used in association with the components described above but which have not been described in detail. For example, curved piece 44 (which may be flexible) may be used to define a curve in the wall, and flat piece 45 having angled engaging means 46, 47 as illustrated in FIG. 10 may be used to negotiate corners and other changes in direction in the wall structure.

While the engaging means of the preferred embodiment have been described in some detail, variations on the specific structure of the engaging means may be practised within the scope of the invention, provided there is a sliding engagement between the cooperating engaging means of the elements and the connecting members to enable the easy erection of the formwork.

It will be appreciated by those skilled in the art that other variations of the preferred embodiment may also be practised without departing from the scope of the invention.

What is claimed is:

1. Modular formwork assembly for casting concrete to form vertical structures, comprising:

a plurality of elongated elements each comprising two opposing longitudinal edges and a surface extending from one longitudinal edge of the elongated element to the opposite longitudinal edge of the elongated element so as to define a cross section having an inner surface and an outer surface and wherein the longitudinal edges are provided with means extending substantially along the length of the longitudinal edges of releasably interconnecting the elongated elements with a connecting member;

a plurality of elongated connecting members, each of said connecting members is a single unitary connecting member comprising a first longitudinal edge, a second longitudinal edge and a central portion defined between said first longitudinal edge and said second longitudinal edge of the connecting member, a plurality of ribs extending between the longitudinal edges along the length of the connecting member and being spaced a distance from one another sufficient to enable the flow of concrete through the central portion, and wherein each of the longitudinal edges of the connecting member is provided with integral means for engaging said interconnecting means of each of two pair of said elongated elements when said elongated elements are presented in edge to edge relationship for connection about opposing sides of the engaging means of the connecting member;

whereby each of said unitary connecting members simultaneously connect each of a first pair of said elongated elements in edge to edge relationship about one edge of the connecting member and each of a second pair of said elongated elements presented in edge to edge relationship about the opposite edge of the connecting member;

said engaging means of said connecting member are adapted to cooperate in longitudinal sliding engagement with said interconnecting means of said elongated elements, whereby engagement between said connecting member engaging means and said elongated element interconnecting means is achieved by sliding one into another; and said cross section of said surface extending from one longitudinal edge to the opposite longitudinal edge of the elongated elements is generally concave.

2. A modular formwork assembly according to claim 1 wherein said elements are provided with inward projections from the surface thereof to anchor the elements to concrete poured into the formwork created by interconnecting a plurality of said elements.

3. A modular formwork assembly according to claim 1 wherein said elements are provided with insulating material on the inner surface of the elements.

4. A modular formwork assembly according to claim 1 wherein said central portion is substantially planar and said connecting members comprise engaging means extending from at least one longitudinal edge of said members in the direction of the plane of said central portion.

5. A modular formwork assembly according to claim 1 further comprising an elongated gap finishing piece comprising a substantially flat surface, a projection extending from said flat surface, and means for attaching said gap finishing piece to said engaging means, said attaching means disposed on said projection and adapted to be inserted by pressure into engagement with said engaging means, wherein said engaging means cooperates in sliding engagement with said attaching means of said gap finishing piece.

6. A modular formwork assembly according to claim 1 wherein said connecting members comprise polyvinyl chloride.

7. A modular formwork assembly according to claim 1 wherein said elongated elements are formed of polyvinyl chloride.

8. A modular formwork assembly according to claim 1 wherein said engaging means are generally T-shaped.

9. A modular formwork assembly according to claim 8 wherein said interconnecting means comprises a generally T-shaped receptacle for receiving said engaging means.

10. Modular formwork assembly for casting concrete to form vertical structures comprising:

elongated elements each comprising a surface extending from one longitudinal edge of the elongated element to the opposite longitudinal edge of the elongated element and wherein the longitudinal edges are provided with means extending substantially along the length of the longitudinal edges for releasably interconnecting the elongated elements with an elongated connecting member;

an elongated connecting member comprising a continuous planar portion extending between a first longitudinal edge of the connecting member and an opposite longitudinal edge of the connecting member, wherein the longitudinal edges on one side of the connecting member are provided with means for engaging said interconnecting means and wherein the longitudinal edges on the opposite side of the connecting member present a flat surface which is substantially continuous with said planar portion;

each of said engaging means of said connecting member cooperates in longitudinal sliding engagement with the interconnecting means on a single one of said elongated elements to close an end of said assembly; and the cross section of said surface extending from one longitudinal edge to the opposite longitudinal edge of the elongated elements is generally concave.

11. A modular formwork assembly according to claim 10 wherein said elements are provided with inward projections from the surface thereof to anchor the elements to concrete poured into the formwork created by interconnecting a plurality of said elements.

12. A modular formwork assembly according to claim 10 wherein said elements are provided with insulating material on the inner surface of the elements.

13. A modular formwork assembly according to claim 10 wherein said engaging means are generally T-shaped.

14. A modular formwork assembly according to claim 13 wherein said interconnecting means comprises a generally T-shaped receptacle for receiving said engaging means.

15. A method of assembling a modular formwork assembly comprising the steps of:

providing a plurality of elongated elements each comprising two opposing longitudinal edges and a surface extending from one longitudinal edge of the elongated element to the opposite longitudinal edge of the elongated element so as to define a cross section having an inner surface and an outer surface and wherein the longitudinal edges are provided with means extending substantially along the length of the longitudinal edges for releasably interconnecting the elongated elements with a connecting member;

providing a plurality of elongated connecting members wherein each of said connecting members is a single unitary connecting member comprising a first longitudinal edge, a second longitudinal edge and a central portion defined between said first longitudinal edge and said second longitudinal edges of the connecting member, a plurality of ribs extending between the longitudinal edges along the length of the connecting member and being spaced a distance from one another sufficient to enable the flow of concrete through the central portion, and wherein each of the longitudinal edges of the connecting member is provided with means for engaging said interconnecting means of each of two pair of said elongated elements when said elongated elements are presented in edge to edge relationship for connection about opposing sides of the engaging means of the connecting member;

erecting a single side of a formwork wall by providing a plurality of said connecting members wherein the engaging means on a single, common side of said plurality of connecting members connect the interconnecting means of a plurality of said elements so as to retain the plurality of elements in edge to edge relationship;

installing reinforcing rods in the spaces between said ribs of said connecting members; and installing a plurality of said elements in edge to edge relationship in engagement with the engaging means on an opposite side of said connecting members to complete a second side of said formwork wall.

16. A method of assembling a modular formwork according to claim 15 wherein said step of providing a plurality of elongated connecting members comprises providing engaging means which are generally T-shaped.

17. A method of assembling a modular formwork according to claim 16 wherein said step of providing a plurality of elongated elements comprises providing interconnecting means which comprise a generally T-shaped receptacle for receiving said engaging means.

* * * * *